US010954833B2

(12) United States Patent
Kontani et al.

(10) Patent No.: US 10,954,833 B2
(45) Date of Patent: Mar. 23, 2021

(54) AIR CLEANER

(71) Applicant: HONDA MOTOR CO., LTD., Tokyo (JP)

(72) Inventors: Masahiro Kontani, Wako (JP); Takeji Kawazumi, Wako (JP); Toshiaki Deguchi, Wako (JP); Shinichi Kurita, Wako (JP); Kensuke Mori, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/516,596

(22) Filed: Jul. 19, 2019

(65) Prior Publication Data

US 2020/0063620 A1 Feb. 27, 2020

(30) Foreign Application Priority Data

Aug. 24, 2018 (JP) ..... JP2018-157193

(51) Int. Cl.

| | |
|---|---|
| ***F01M 13/04*** | (2006.01) |
| ***F02B 61/02*** | (2006.01) |
| ***F01M 13/02*** | (2006.01) |
| ***F01M 13/00*** | (2006.01) |

(52) U.S. Cl.

CPC .... *F01M 13/0416* (2013.01); *F01M 13/0011* (2013.01); *F01M 13/023* (2013.01); *F02B 61/02* (2013.01); *F01M 2013/0044* (2013.01)

(58) Field of Classification Search

CPC ..... F02M 13/0416; F02M 13/023; F02M 13/0011; F02M 13/022; F02M 35/0207; F02M 35/10222; F02M 35/162; F02M 25/06; F02B 61/02; F01M 2013/0044

See application file for complete search history.

(56) References Cited

U.S. PATENT DOCUMENTS

| | | | | |
|---|---|---|---|---|
| 4,995,891 | A | 2/1991 | Jaynes | |
| 2001/0050193 | A1 | 12/2001 | Yoshida et al. | |
| 2003/0226553 | A1 * | 12/2003 | Yasui ..... | F02M 35/10222 123/573 |

(Continued)

FOREIGN PATENT DOCUMENTS

| | | | |
|---|---|---|---|
| CN | 206636675 | U | 11/2017 |
| JP | 7-119431 | A | 5/1995 |

(Continued)

*Primary Examiner* — George C Jin

(74) *Attorney, Agent, or Firm* — Birch, Stewart, Kolasch & Birch, LLP

(57) ABSTRACT

An air cleaner includes: an air cleaner box defining a clean chamber that is placed rearward of a dirty chamber, the clean chamber receiving air which has been introduced from front into the dirty chamber and then filtered through an air cleaner element; and funnels that are to be connected to an intake port of an internal combustion engine, the funnels protruding upward into a space within the air cleaner box from a bottom wall of the air cleaner box. The air cleaner further includes a breather chamber into which blow-by gas is introduced from the internal combustion engine, the breather chamber being placed rearward of the funnels and between the funnels and a rear wall of the air cleaner box. Accordingly, the air cleaner can further promote the air-liquid separation of blow-by gas without incurring an increase in weight of the internal combustion engine.

7 Claims, 7 Drawing Sheets

(56) References Cited

U.S. PATENT DOCUMENTS

| | | | | |
|---|---|---|---|---|
| 2007/0289583 | A1 | 12/2007 | Konakawa et al. | |
| 2013/0306044 | A1* | 11/2013 | Tanaka | F02M 35/0207 123/573 |
| 2015/0275717 | A1* | 10/2015 | Kontani | F02M 35/162 123/572 |
| 2018/0313304 | A1* | 11/2018 | Ojima | F02M 35/162 |
| 2019/0003357 | A1* | 1/2019 | Isoshima | F02M 35/10222 |

FOREIGN PATENT DOCUMENTS

| | | | |
|---|---|---|---|
| JP | 2003-56325 | A | 2/2003 |
| JP | 3911950 | B2 | 5/2007 |
| JP | 2013-238176 | A | 11/2013 |
| JP | 2015-187409 | A | 10/2015 |
| KR | 10-1561882 | B1 | 10/2015 |
| WO | WO 2005/100776 | A1 | 10/2005 |

* cited by examiner

AIR CLEANER

CROSS REFERENCE TO RELATED APPLICATIONS

The present application claims priority under 35 U.S.C. § 119 to Japanese Patent Application No. 2018-157193 filed Aug. 24, 2018 the entire contents of which are hereby incorporated by reference.

BACKGROUND OF THE INVENTION

Fieled of the Invention

The present invention relates to an air cleaner, comprising: an air cleaner box defining a clean chamber that is placed rearward of a dirty chamber, the clean chamber receiving air which has been introduced from front into the dirty chamber and then filtered through an air cleaner element; and funnels that are to be connected to an intake port of an internal combustion engine, the funnels protruding upward into a space within the air cleaner box from a bottom wall of the air cleaner box.

Description of the Related Art

Japanese Patent No. 3911950 discloses a breather apparatus that allows blow-by gas to escape from a crankcase into an air cleaner in response to pressure fluctuations in the crankcase. The breather apparatus includes a breather cover attached to the crankcase. The breather cover defines a breather chamber. Engine oil entrained in the blow-by gas is separated in the breather chamber. After such air-liquid separation, the blow-by gas is introduced into a clean chamber in an air cleaner box through a breather hose.

As disclosed in Japanese Patent No. 3911950, the air-liquid separation performance depends upon the volume of the breather chamber. If an increase in volume of the breather chamber is achieved without incurring enlargement of size of an internal combustion engine, this will enable an improved performance of air-liquid separation of blow-by gas while inhibiting the increase in weight of the internal combustion engine.

SUMMARY OF THE INVENTION

The present invention has been achieved in view of the above-mentioned circumstances, and it is an object thereof to provide an air cleaner capable of further promoting the air-liquid separation of blow-by gas without incurring an increase in weight of an internal combustion engine.

In order to achieve the object, according to a first aspect of the present invention, there is provided an air cleaner, comprising: an air cleaner box defining a clean chamber that is placed rearward of a dirty chamber, the clean chamber receiving air which has been introduced from front into the dirty chamber and then filtered through an air cleaner element; and funnels that are to be connected to an intake port of an internal combustion engine, the funnels protruding upward into a space within the air cleaner box from a bottom wall of the air cleaner box, wherein the air cleaner further comprises a breather chamber into which blow-by gas is introduced from the internal combustion engine, the breather chamber being placed rearward of the funnels and between the funnels and a rear wall of the air cleaner box.

With the first aspect, because the breather chamber is defined within the air cleaner box, an increase in volume of the breather chamber is enabled without incurring enlargement of size of the internal combustion engine. Thus, it is possible to improve the performance of air-liquid separation of blow-by gas while inhibiting an increase in weight of the internal combustion engine.

According to a second aspect of the present invention, in addition to the first aspect, there is provided the air cleaner, further comprising a connection passage that connects a space within the breather chamber to a space within the clean chamber, the connection passage being located in a lower position than an entrance end face of each of the funnels.

With the second aspect, the blow-by gas in the breather chamber flows through the connection passage into the space within the clean chamber. Accordingly, by locating the connection passage in a lower position of the entrance end face of the funnels, it is possible to prevent the engine oil entrained in the blow-by gas from flowing into the funnels.

According to a third aspect of the present invention, in addition to the first aspect or the second aspect, the connection passage is elongated in an axis direction of the funnels.

With the third aspect, because blowing of the blow-by gas into the space in the clean chamber spreads in the axis direction of the funnels, the amount of inflow of the blow-by gas is secured, and additionally, an inflow of the engine oil entrained in the blow-by gas is more effectively prevented.

According to a fourth aspect of the present invention, in addition to the third aspect, the connection passage is placed rearward of each of the funnels.

With the fourth aspect, distribution of the blow-by gas on a funnel-by-funnel basis is enabled, and additionally, the blow-by gas is able to flow into the funnels through the shortest path.

According to a fifth aspect of the present invention, in addition to the first aspect, there is provided the air cleaner, further comprising an enclosing wall and a ceiling wall, the enclosing wall extending continuously from the rear wall of the air cleaner box to define a space which is divided from the clean chamber, the space being opened at an upper end thereof, the ceiling wall being joined to an upper end of the enclosing wall, the ceiling wall defining the breather chamber by closing the upper end of the space defined by the enclosing wall.

With the fifth aspect, only by joining the ceiling wall to the upper end of the enclosing wall, the breather chamber is able to be divided from the clean chamber within the air cleaner box. Thus, the breather chamber can be provided in the air cleaner box by a simple structure.

According to a sixth aspect of the present invention, in addition to the fifth aspect, the enclosing wall has a slit formed to extend downward from the upper end of the enclosing wall.

With the sixth aspect, the slit has the function as the connection passage of connecting the space in the breather chamber to the space in the clean chamber. Because the slit narrows the outflow port as compared with the volume of the breather chamber, the slit can contribute to the capture of engine oil in the breather chamber. The slit can be formed at the time when the air cleaner box is molded. This enables simplification of the process of forming the breather chamber.

According to a seventh aspect of the present invention, in addition to the sixth aspect, the slit is placed rearward of each of the funnels.

With the seventh aspect, distribution of the blow-by gas on a funnel-by-funnel basis is enabled, and additionally, the blow-by gas is able to flow into the funnels through the shortest path.

The above and other objects, characteristics and advantages of the present invention will be clear from detailed descriptions of the preferred embodiment which will be provided below while referring to the attached drawings.

DESCRIPTION OF THE PREFFERRED EMBODIMENT

An embodiment according to the present invention will now be described with reference to the accompanying drawings. As used herein, the upward, downward, frontward, rearward, leftward and rightward of the vehicle body shall be defined as directions based on a line of sight of an occupant riding on a two-wheeled motor vehicle.

Figure 1:
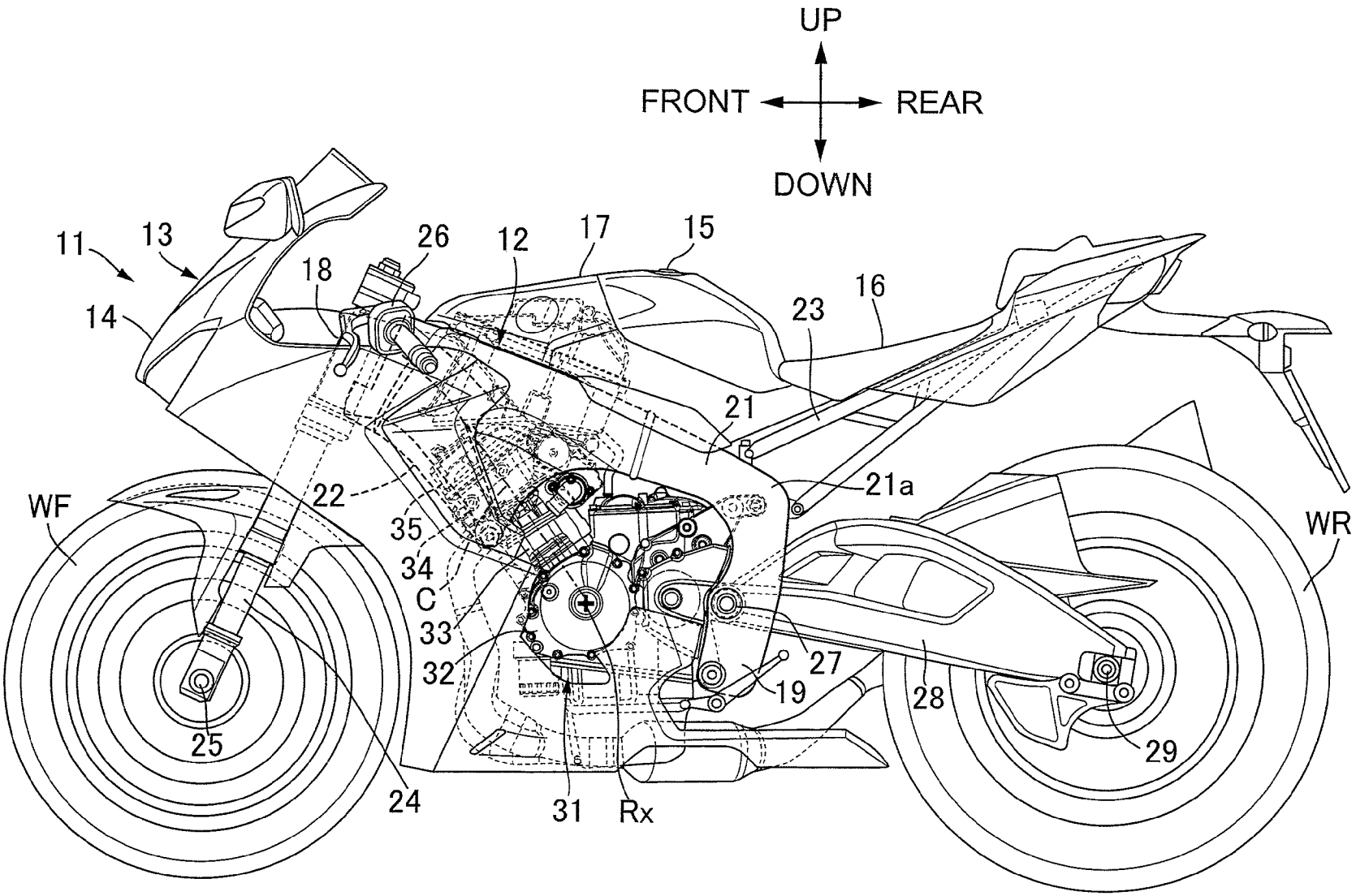
FIG. 1 is a schematic side view illustrating the overall configuration of a two-wheeled motor vehicle according to an embodiment.

FIG. 1 schematically illustrates an overview of a two-wheeled motor vehicle which is a saddle riding vehicle according to an embodiment of the present invention. The two-wheeled motor vehicle 11 includes a body frame 12 and a body cover 13 that is attached to the body frame 12. The body cover 13 has a front cowl 14 and a tank cover 17. The front cowl 14 covers the body frame 12 from the front. The tank cover 17 extends continuously frontward from the outer surface of a fuel tank 15, and also the tank cover 17 is connected to an occupant seat 16 located rearward of the fuel tank 15. The fuel tank 15 stores fuel. The occupant is astride the occupant seat 16 to operate the two-wheeled motor vehicle 11.

The body frame 12 has: a head pipe 18; a pair of left and right main frames 21 that extend downwardly toward the rear from the head pipe 18, the main frames 21 having pivot frames 19 at the lower rear ends; down frames 22 that are located below the main frames 21 to extend downward from the head pipe 18, the down frames 22 being integrated with the main frames 21; and left and right seat frames 23 that extend upwardly toward the rear from bent regions 21*a* of the respective main frames 21 to form a truss structure. The seat frames 23 support the occupant seat 16.

The head pipe 18 steerably supports a front fork 24. The front fork 24 supports a front wheel WF rotatably about an axle 25. The front fork 24 has an upper end to which a steering handlebar 26 is joined. The rider holds the grips at the left and right ends of the steering handlebar 26 when he/she operates the two-wheeled motor vehicle 11.

In a rear section of the vehicle body, a swing arm 28 is coupled to the body frame 12 so as to be swingable in the up-down direction about a pivot 27. The swing arm 28 has a rear end at which a rear wheel WR is supported rotatably about an axle 29. An internal combustion engine 31 is mounted on the body frame 12 between the front wheel WF and the rear wheel WR, and the internal combustion engine 31 produces power which is to be transferred to the rear wheel RW. The internal combustion engine 31 is coupled and supported to the down frames 22 and the main frames 21. The power of the internal combustion engine 31 is transferred through a power transmission device to the rear wheel WR.

Figure 2:
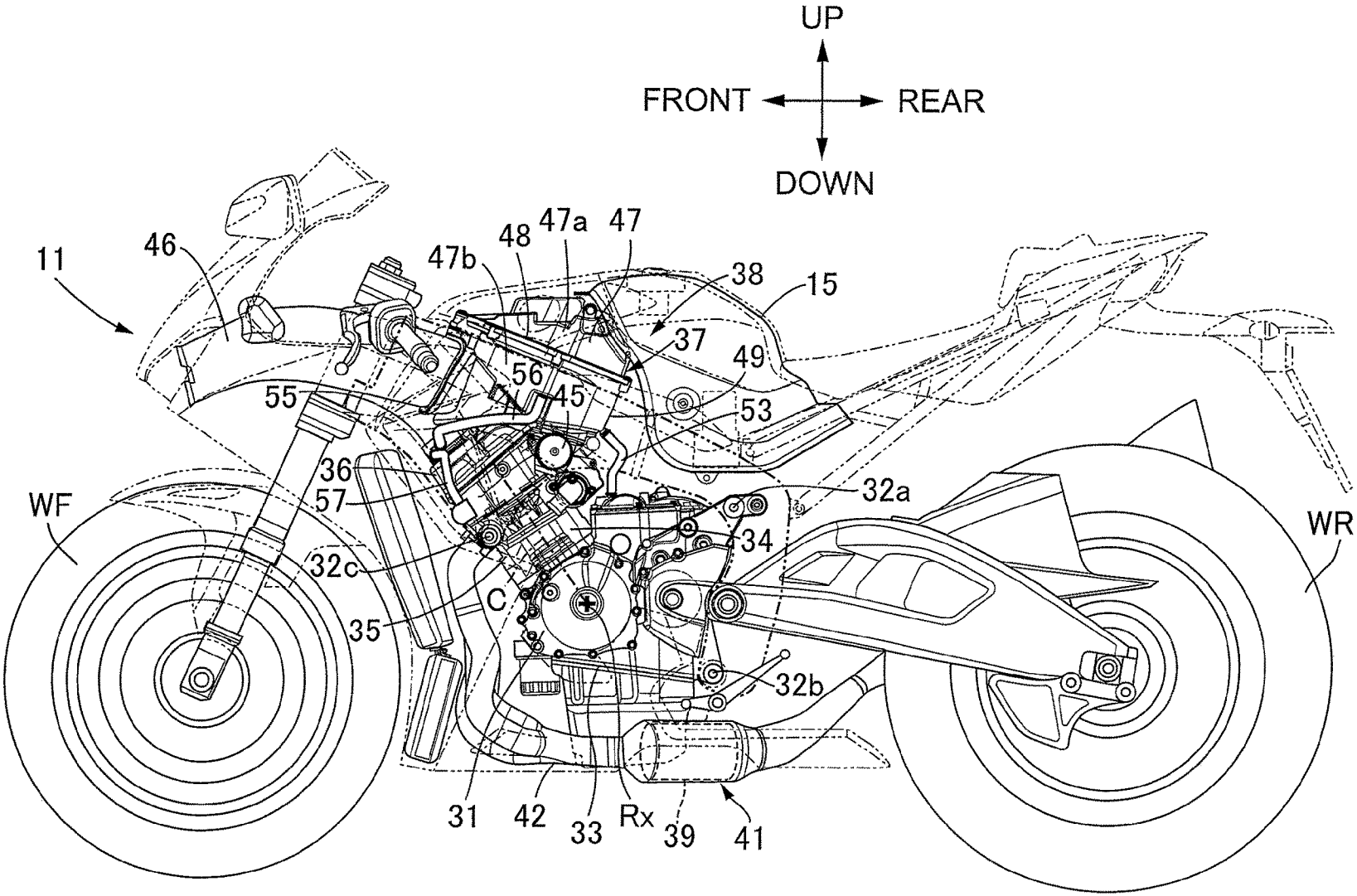
FIG. 2 is a schematic side view illustrating the overall configuration of the two-wheeled motor vehicle from which a body cover is dismounted.

As illustrated in FIG. 2, an engine body of the internal combustion engine 31 includes a crankcase 33, a cylinder block 34, a cylinder head 35 and a head cover 36. The crankcase 33 has engine hangers 32*a*, 32*b* placed at an upper end and a lower end of a rear wall, the engine hangers 32*a*, 32*b* being coupled to the main frames 21. The crankcase 33 also outputs the power about a rotation axis Rx. The cylinder block 34 is joined to a front portion of the crankcase 33 from above, and the cylinder block 34 has a cylinder axis C that is located within a vertical plane orthogonal to the rotation axis Rx, the cylinder axis C being upright from the horizontal plane. The cylinder head 35 is joined to an upper end of the cylinder block 34. The cylinder head 35 has an engine hanger 32*c* at the front wall, the engine hanger 32*c* being coupled to the down frames 22. The cylinder head 35 supports a valve train. The head cover 36 is joined to an upper end of the cylinder head 35 to cover the valve train on the cylinder head 35. In the embodiment, the cylinder block 34 has four cylinders arranged in series in the vehicle width direction specified by the rotation axis Rx parallel to the axle 29.

The cylinder head 35 is connected to an intake device 38 and an exhaust device 41. The intake device 38 produces an air-fuel mixture by spraying fuel into air which has been cleaned in an air cleaner 37, and then the intake device 38 supplies the air-fuel mixture into a combustion chamber which is covered with the cylinder head 35. The exhaust device 41 uses a catalyst 39 to clean the combustion exhaust gas emitted from the combustion chamber, and then the exhaust device 41 emits the exhaust gas in a rearward direction of the vehicle body while decreasing the temperature of the exhaust gas. The exhaust device 41 includes an exhaust pipe 42 that passes under the crankcase 33 and then extends along the side of the rear wheel WR, and, under the crankcase 33, the exhaust pipe 42 supports the catalyst 39.

The air cleaner 37 includes an air cleaner box 47 that is combined via a throttle body 45 with the cylinder head 35, and the air cleaner box 47 takes in travelling air from an air duct 46 opening in front of the head pipe 18. The air cleaner 37 takes in traveling air into the air cleaner box 47 to clean the traveling air, and then the air cleaner 37 delivers the cleaned air to the internal combustion engine 31. The air cleaner box 47 is covered with the fuel tank 15 from the rear. The air cleaner box 47 has an upper body 47*a* and a lower body 47*b* that are joined together at a mating surface 48 which is set along a plane tilting downwardly toward the rear. The upper body 47*a* and the lower body 47*b* have a rear wall 49 that crosses at right angles to the mating surface 48 to widen in the vehicle width direction.

Figure 3:
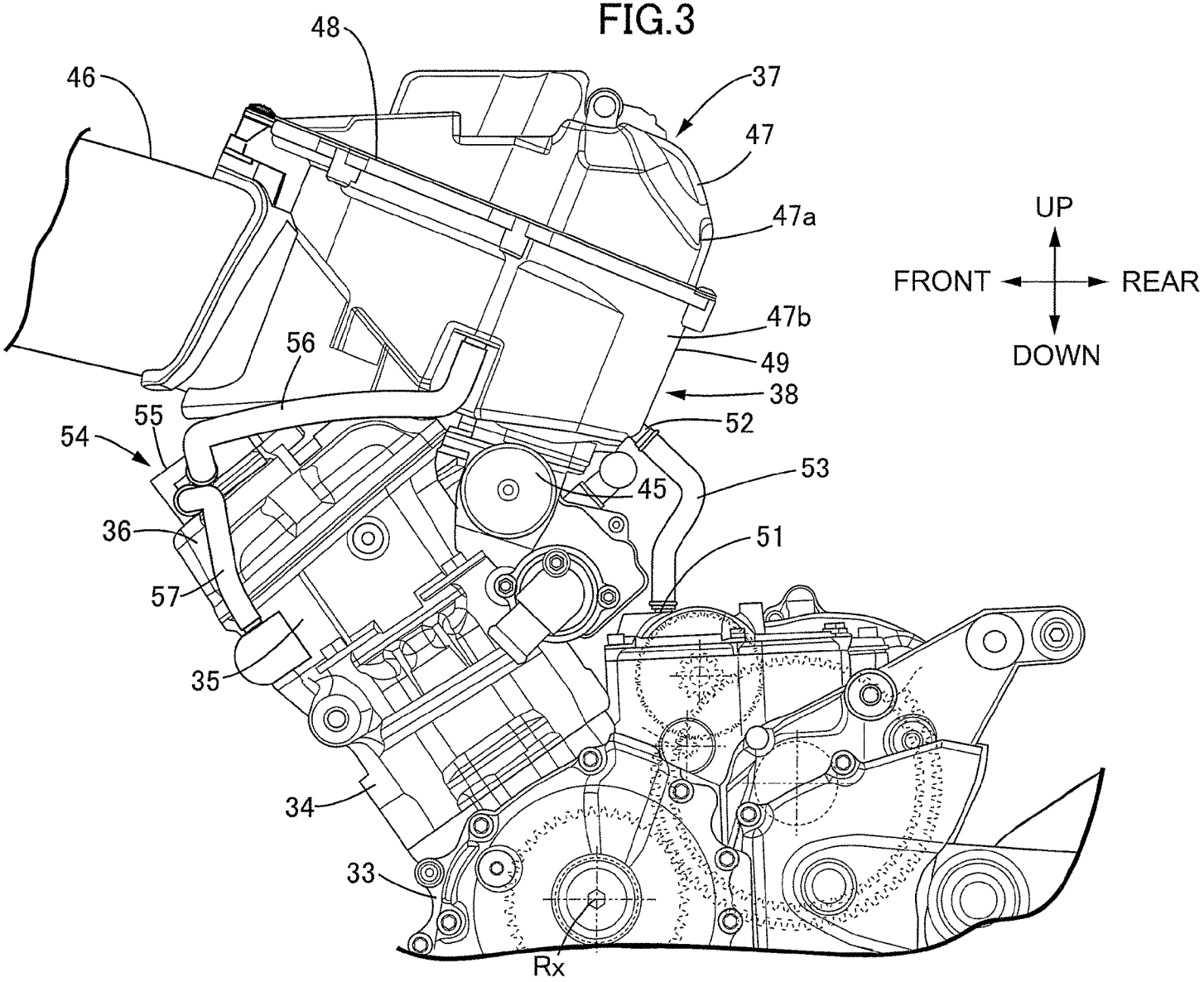
FIG. 3 is an enlarged side view of an internal combustion engine and an air cleaner box.

As illustrated in FIG. 3, a breather cover 51 is attached to the upper surface of the crankcase 33 at the rear of the cylinder block 34, and the breather cover 51 defines a breather chamber that is connected to a crank chamber in the crankcase 33. A breather tube 53 is joined to the breather cover 51 and the breather tube 53 extends from a joint 52 which is installed at a lower end of the rear wall 49 of the air cleaner box 47. Blow-by gas within the crankcase 33 is introduced through the breather tube 53 into the air cleaner box 47. The interior of the breather chamber is configured to have a labyrinth structure. The air-liquid separation of the blow-by gas is achieved in the breather chamber. Engine oil separated from the blow-by gas flows into the crank chamber.

The internal combustion engine 31 is connected to a secondary air introduction system 54 that takes in outside-air to deliver the outside-air toward the exhaust pipe 42. The secondary air introduction system 54 includes: a secondary air control valve 55 that is installed under the air cleaner box 47 and on the upper surface of the head cover 36; a first supply tube 56 that extends from the air cleaner box 47 to be connected to the secondary air control valve 55; and second supply tubes 57 that branch off from the secondary air control valve 55 toward left and right exhaust ports to be joined to the cylinder head 35. In response to negative pressure produced in the exhaust pipe 42, the air cleaned by the air cleaner 37 is sucked into the exhaust ports of the cylinder head 35. The amount of air flowing into the exhaust ports is adjusted by action of the secondary air control valve 55.

Figure 4:
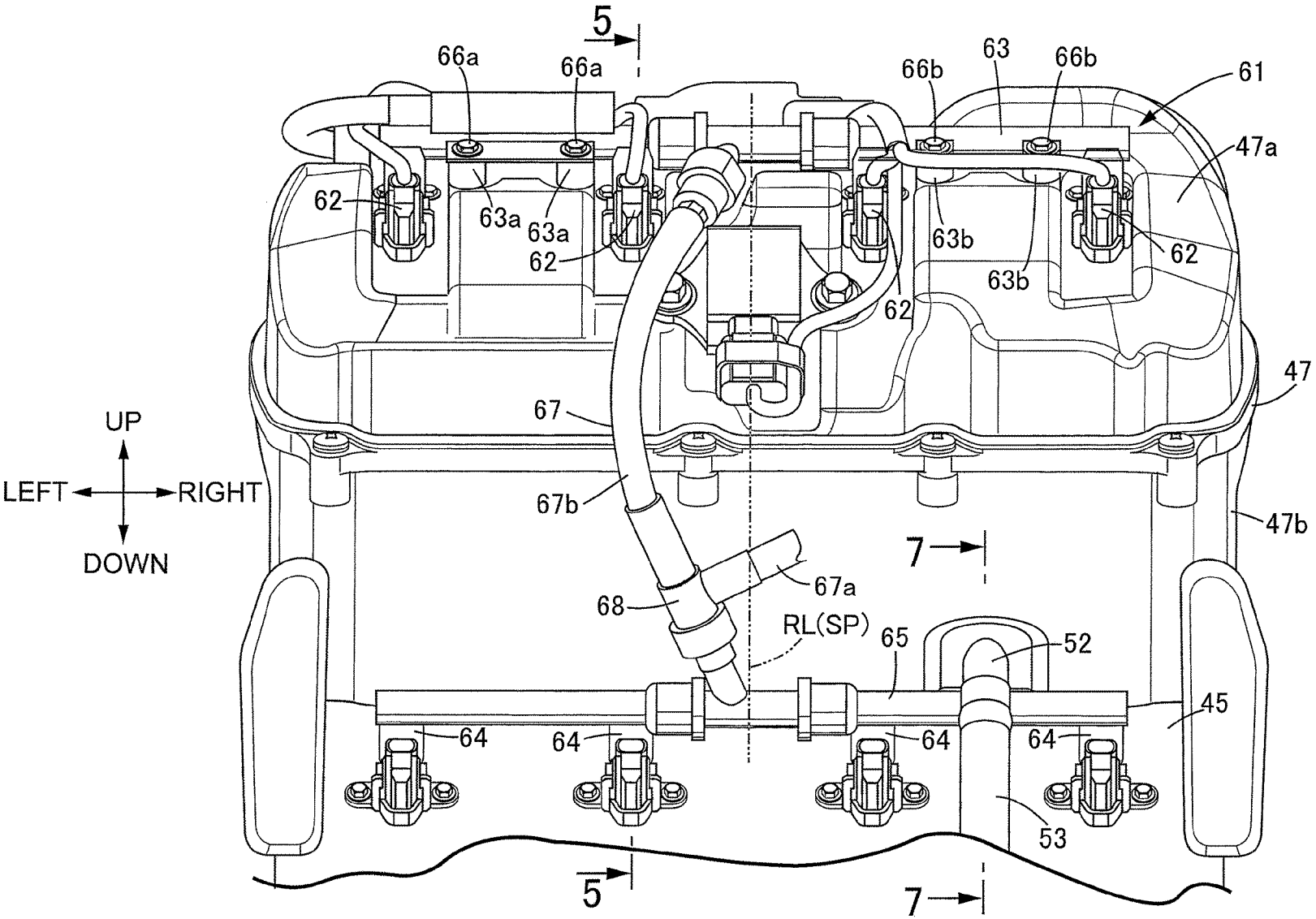
FIG. 4 is an enlarged rear view of the air cleaner box when observed from rear.

As illustrated in FIG. 4, a fuel supply system 61 includes upper injectors 62, a first fuel supply pipe 63, main injectors 64, and a second fuel supply pipe 65. The upper injectors 62 are incorporated into an upper wall of the air cleaner box 47 on a cylinder-by-cylinder basis. The first fuel supply pipe 63 extends linearly in the vehicle width direction above the air cleaner box 47, and the first fuel supply pipe 63 has branch pipes corresponding to the individual upper injectors 62 in order to supply fuel to the individual upper injectors 62 from the branch pipes. The main injectors 64 are incorporated into the throttle body 45 on a cylinder-by-cylinder basis. The second fuel supply pipe 65 extends linearly in the vehicle width direction at the rear of the throttle body 45, and the second fuel supply pipe 65 has branch pipes corresponding to the individual main injectors 64 in order to supply fuel to the individual main injectors 64 from the branch pipes. The first fuel supply pipe 63 has two brackets 63*a* and two brackets 63*b* formed thereon. The two brackets 63*a* are placed between a left pair of upper injectors 62, and the two brackets 63*a* are secured to the upper wall of the air cleaner box 47 by respective bolts 66*a*. The two brackets 63*b* are placed between a right pair of upper injectors 62, and the two brackets 63*b* are secured to the upper wall of the air cleaner box 47 by respective bolts 66*b*. The individual brackets 63*a*, 63*b* are laid on the upper wall of the air cleaner box 47.

A fuel supply tube 67 is connected to the first fuel supply pipe 63 and the second fuel supply pipe 65. The fuel supply pipe 67 includes a first tube 67*a* and a second tube 67*b*. The first tube 67*a* extends from a fuel pump which is placed in the fuel tank 15, and then the first tube 67*a* is connected to a connecting pipe 68 fixed to the second fuel supply pipe 65. The second tube 67*b* branches off from the connecting pipe 68 of the second fuel supply pipe 65 to be connected to the first fuel supply pipe 63. The fuel within the fuel tank 15 is forcedly supplied to the first fuel supply pipe 63 and the second fuel supply pipe 65 by action of the fuel pump.

Figure 5:
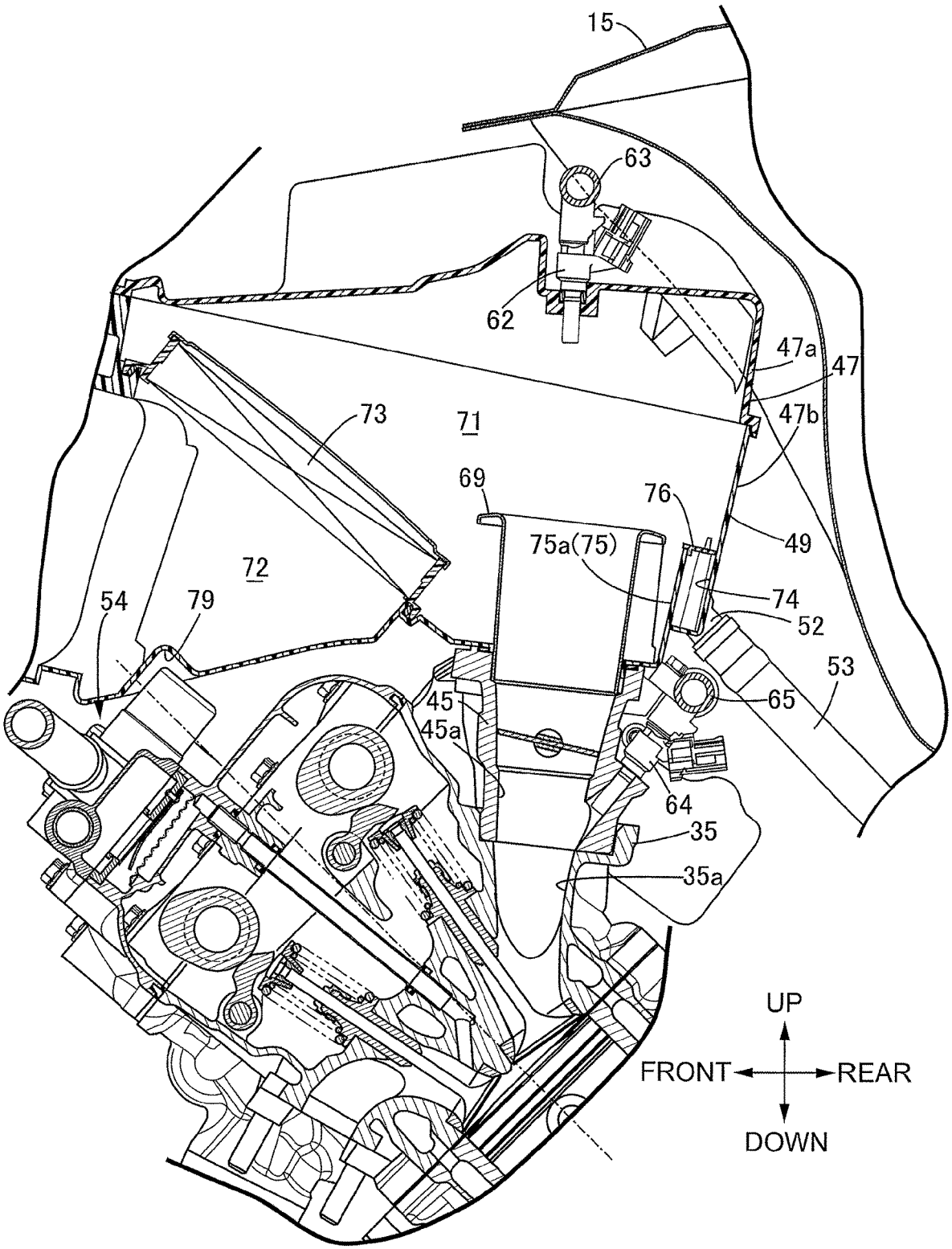
FIG. 5 is a schematic view illustrating the configuration of an intake device, the schematic view corresponding to a vertical sectional view taken along line 5-5 of FIG. 4.

As illustrated in FIG. 5, each individual upper injector 62 sprays fuel downward toward a funnel 69 which is placed rearward inside the air cleaner box 47. The funnel 69 is joined to the throttle body 45 on a cylinder-by-cylinder basis, and the funnel 69 passes through a bottom wall of the air cleaner box 47 laid on the throttle body 45, the funnel 69 protruding upward into a clean chamber 71 in the air cleaner box 47. An air cleaner element 73 divides the space within the air cleaner box 47 into two: a frontward-side dirty chamber 72 that is connected to the air duct 46 to take in traveling air from the air duct 46; the rearward-side clean chamber 71. The air in the dirty chamber 72 is filtered through the air cleaner element 73, followed by flowing into the clean chamber 71. The cleaned air flows from the funnel 69 through an intake passage 45*a* in the throttle body 45 into an intake port 35*a* of the cylinder head 35. In low rotational speeds of the internal combustion engine 31, the fuel is injected from the main injector 64 in the intake passage 45*a* in the throttle body 45. In high rotational speeds of the internal combustion engine 31, the fuel is injected from the upper injector 62 in the clean chamber 71, and an air-fuel ratio is adjusted by the fuel injected from the main injector 64.

A breather chamber 74 is placed rearward of the funnel 69 between the funnel 69 and the rear wall 49 of the air cleaner box 47, and blow-by gas is introduced from the internal combustion engine 31 into the breather chamber 74. For forming the breather chamber 74, the air cleaner box 47 has an enclosing wall 75 and a ceiling wall 76. The enclosing wall 75 extends continuously from the rear wall 49 to define a space which is divided from the clean chamber 71, the space is opened at an upper end. The ceiling wall 76 is joined to an upper end of the enclosing wall 75, and the ceiling wall 76 defines the breather chamber 74 by closing the upper end of the space defined by the enclosing wall 75.

Figure 7:
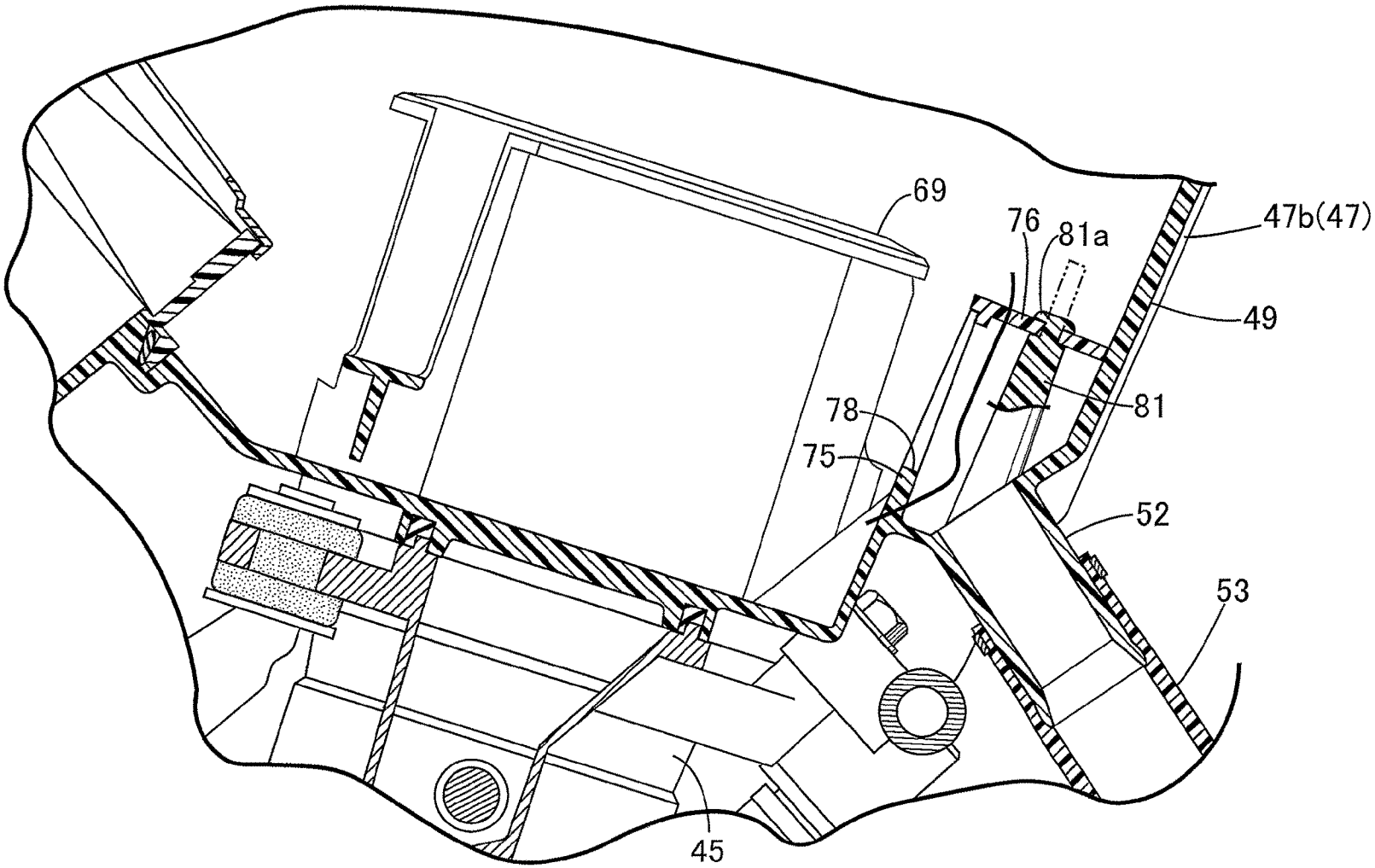
FIG. 7 is an enlarged vertical sectional view of the air cleaner box taken along line 7-7 of FIG. 4.

A column 81 is formed in the breather chamber 74 and the column 81 stands upright alongside the rear wall 49 from the lower end of the rear wall 49. An upper end of the column 81 supports the ceiling wall 76 from below. As illustrated in FIG. 7, the upper end of the column 81 has a smaller shaft integrally formed thereon, and the smaller shaft makes an entry into a through hole in the ceiling wall 76 to protrude upward. The smaller shaft is heated and crushed from above to form a disconnection prevention element 81*a* which is to couple the ceiling wall 76 with the upper end of the column 81.

Figure 6:
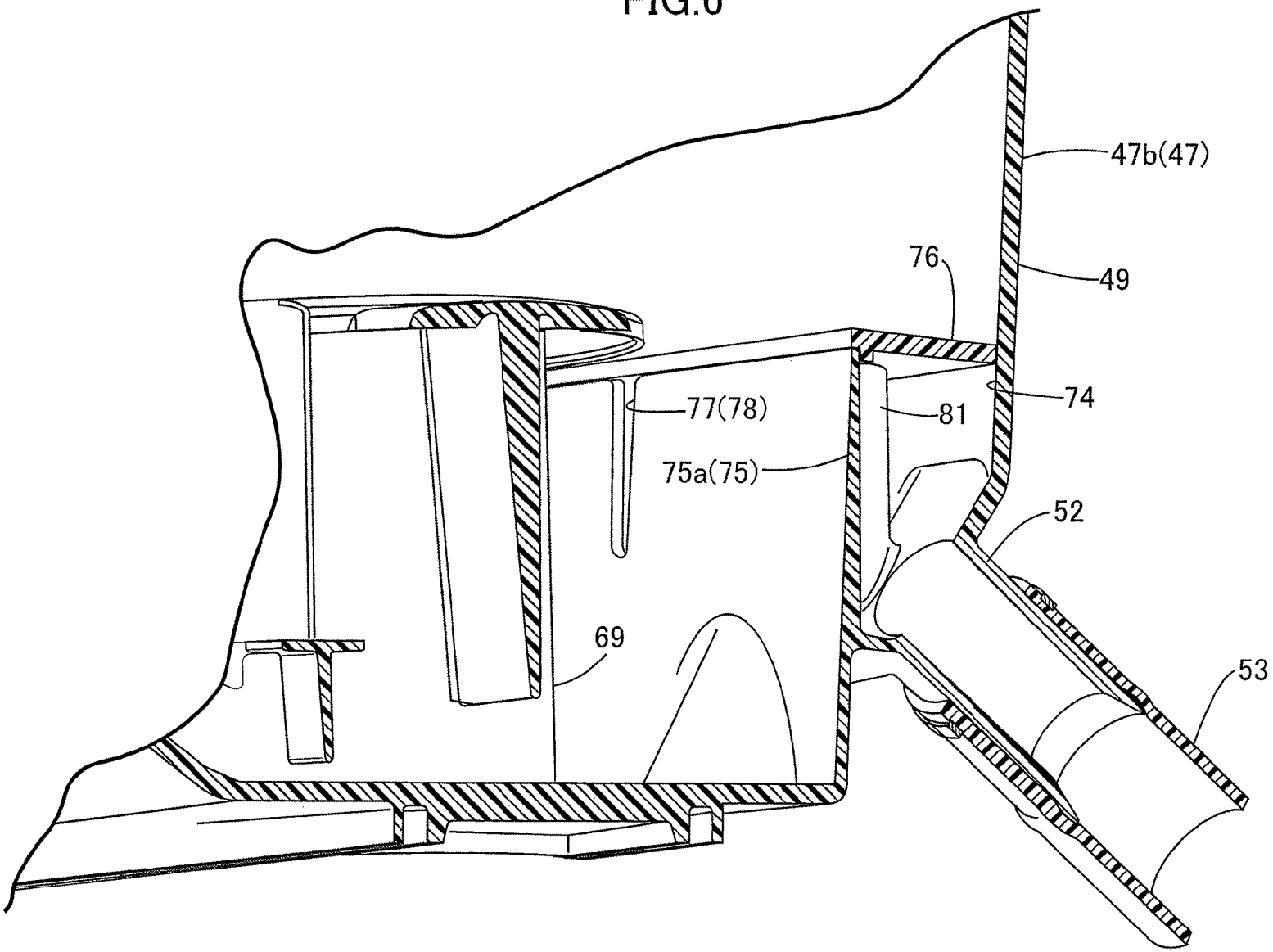
FIG. 6 is an enlarged partial sectional view of the air cleaner box when observed in vertical section including the axis of a joint of a breather tube.

As illustrated in FIG. 6, the enclosing wall 75 has a front wall 75*a* that faces the rear wall 49 with the breather chamber 74 interposed between the front wall 75*a* and the rear wall 49, and the front wall 75*a* extends in the vehicle width direction. The front wall 75*a* has left and right ends respectively continuous to side walls leading from the rear wall 49. Therefore, the breather chamber 74 extends rearward of the four funnels 69. As illustrated in FIG. 4, the joint 52 is formed in an intermediate position between the two right funnels 69 in the air cleaner box 47. The joint 52 is inclined upwardly toward the front while opening to a lower end of the breather chamber 74.

As illustrated in FIG. 6, the enclosing wall 75 has slits 77 formed therein to extend downward from the upper end, the slits 77 being respectively placed rearward of the funnels 69 on an individual funnel 69 basis. Each slit 77 forms a connection passage 78 connecting the space within the clean chamber 71 to the space within the breather chamber 74. Therefore, the connection passage 78 is elongated in the axis direction of the funnel 69. Because the slit 77 is placed rearward of the funnel 69, the slit 77 is opened so as to be displaced in the vehicle width direction from the axis of the joint 52 which is placed in an intermediate position between the funnels 69. As illustrated in FIG. 7, the connection passage 78 is located in a lower position than an entrance end face of the funnel 69.

As illustrated in FIG. 5, a clearance 79 is formed inside the dirty chamber 72 and on the bottom wall of the air cleaner box 47, in order to circumvent the secondary air control valve 55. The clearance 79 is recessed from the outer surface of the air cleaner box 47 to bulge into the dirty chamber 72. The bulge of the clearance 79 is set to be more moderate on the frontward side than on the rearward side of the top. Accordingly, turbulence of the airflow along the bottom wall within the dirty chamber 72 is suppressed.

Next, the flow of blow-by gas will be described. During the operation of the internal combustion engine 31, blow-by gas escapes from the combustion chamber into the crank chamber in the crankcase 33. The blow-by gas flows from the crank chamber into the breather chamber covered with the breather cover 51. The air-liquid separation of the blow-by gas is accomplished in the breather chamber. Engine oil separated from the blow-by gas flows back into the crank chamber. The blow-by gas flows from the breather chamber of the crankcase 33 through the breather tube 53 into the air cleaner box 47.

The blow-by gas is breathed into the breather chamber 74 in the air cleaner box 47 from the joint 52 of the breather tube 53. The blow-by gas impinges on the front wall 75*a* from an oblique direction, and then the blow-by gas spreads out in the vehicle width direction while flowing along the ceiling wall 76, the rear wall 49 and the bottom wall from the front wall 75*a*. Because the temperature is lower in the air cleaner box 47 than in the crankcase 33, the oil mist in the blow-by gas is apt to coagulate, and therefore the air-liquid separation is efficiently accomplished. The engine oil is collected by adhering to the walls. Subsequent to the air-liquid separation, the blow-by gas flows from the connection passage 78 into the clean chamber 71.

The blow-by gas in the breather chamber 74 flows into the space in the clean chamber 71 through the connection passage 78. Because of this, the connection passage 78 is located in a lower position than the entrance end face of the funnel 69. Thereby, the engine oil entrained in the blow-by gas is prevented from flowing into the funnel 69. In addition, because the connection passage 78 is elongated in the axis direction of the funnel 69, blowing of the blow-by gas into the space in the clean chamber 71 spreads in the axis direction (gravity direction) of the funnel 69, so that the blow-by gas needs to come into contact with the walls when entering the connection passage 78. As a result, the amount of inflow of the blow-by gas is secured, and additionally, an inflow of the engine oil entrained in the blow-by gas is more effectively prevented.

Each connection passage 78 is placed rearward of the funnel 69 on a funnel-by-funnel 69 basis. This makes it possible to distribute the blow-by gas on a funnel-by-funnel 69 basis, and additionally, the blow-by gas flows into the funnel 69 through the shortest path.

In the embodiment, because the breather chamber 74 is defined within the air cleaner box 47, an increase in volume of the breather chamber is enabled without incurring enlargement of size of the internal combustion engine 31. Thus, it is possible to improve the performance of air-liquid separation of blow-by gas while inhibiting an increase in weight of the internal combustion engine 31.

In the embodiment, the enclosing wall 75 is formed in the air cleaner box 47 to extend continuously from the rear wall 49 of the air cleaner box 47, and the enclosing wall 75 defines and divides the space from the clean chamber 71, the space having an open upper end. The ceiling wall 76 is joined to the upper end of the enclosing wall 75, and the ceiling wall 76 closes the upper end of the space defined by the enclosing wall 75, to define the breather chamber 74. By simply joining the ceiling wall 76 to the upper end of the enclosing wall 75, the breather chamber 74 is able to be divided from the clean chamber 71 within the air cleaner box 74, and thus the breather chamber 74 can be established in the air cleaner box 47 by a simple structure.

In the air cleaner box 47, the slits 77 are formed to extend downward from the upper end of the enclosing wall 75. Each slit 77 has the function as the connection passage 78 of connecting the space in the breather chamber 74 to the space in the clean chamber 71. Because the slit 77 narrows the outflow port as compared with the volume of the breather chamber 74, the slit 77 contributes to the capture of engine oil in the breather chamber 74. The slits 77 can be formed at the same time when the air cleaner box 47 is molded. This enables simplification of the process of forming the breather chamber 74.

What is claimed is:

1. An air cleaner, comprising:

an air cleaner box defining a clean chamber that is placed rearward of a dirty chamber, the clean chamber receiving air which has been introduced from a front into the dirty chamber and then filtered through an air cleaner element;

funnels that are to be connected to intake ports of an internal combustion engine, respectively, the funnels protruding upward into a space within the air cleaner box from a bottom wall of the air cleaner box; and a breather chamber into which blow-by gas is introduced from the internal combustion engine, the breather chamber being placed in another space rearward of the funnels and between the funnels and a rear wall of the air cleaner box, said another space being divided from the clean chamber and defined by an enclosing wall that is formed to extend continuously from the rear wall, wherein a slit is formed to extend downward from an upper end of the enclosing wall.

2. The air cleaner according to claim 1, wherein the slit serves as a connection passage that connects an inside of the breather chamber to the clean chamber, the connection passage being located in a lower position than an entrance end face of each of the funnels.

3. The air cleaner according to claim 1, wherein the slit serves as a connection passage that connects an inside of the breather chamber to the clean chamber, and wherein the connection passage is elongated in an axis direction of the funnels.

4. The air cleaner according to claim 2, wherein the connection passage is elongated in an axis direction of the funnels.

5. The air cleaner according to claim 3, wherein the connection passage is placed rearward of each of the funnels.

6. The air cleaner according to claim 4, wherein the connection passage is placed rearward of each of the funnels.

7. The air cleaner according to claim 1, further comprising a ceiling wall, said another space being opened at an upper end thereof, the ceiling wall being joined to an upper end of the enclosing wall, the ceiling wall defining the breather chamber by closing an upper end of said another space defined by the enclosing wall.

* * * * *